US012473795B2

(12) United States Patent
Dave et al.

(10) Patent No.: US 12,473,795 B2
(45) Date of Patent: Nov. 18, 2025

(54) RATCHETING SETTING TOOL FOR AN EXPANDABLE SEAL IN A WELLBORE

(71) Applicant: Halliburton Energy Services, Inc., Houston, TX (US)

(72) Inventors: Jalpan Piyush Dave, Singapore (SG); Michael Linley Fripp, Singapore (SG); Scott E. Wallace, Singapore (SG); Brandon T. Least, Flower Mound, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 42 days.

(21) Appl. No.: 18/590,085

(22) Filed: Feb. 28, 2024

(65) Prior Publication Data

US 2025/0270892 A1 Aug. 28, 2025

(51) Int. Cl.
*E21B 33/128* (2006.01)
*E21B 23/04* (2006.01)

(52) U.S. Cl.
CPC ..... *E21B 33/128* (2013.01); *E21B 23/0416* (2020.05)

(58) Field of Classification Search
CPC .... E21B 33/128; E21B 23/0416; E21B 23/04; E21B 33/12
See application file for complete search history.

(56) References Cited

U.S. PATENT DOCUMENTS 4,545,433 A 10/1985 Wambaugh
4,586,526 A * 5/1986 Reardon ..... F16K 7/10 137/71
4,653,588 A 3/1987 White
(Continued)

FOREIGN PATENT DOCUMENTS

BR 112021007440 A2 7/2021
GB 2296273 A * 6/1996 ..... E21B 33/127
(Continued)

OTHER PUBLICATIONS

International Patent Application No. PCT/US2024/017650, International Search Report and Written Opinion mailed Nov. 22, 2024, 12 pages.
(Continued)

*Primary Examiner* — Daniel P Stephenson
(74) *Attorney, Agent, or Firm* — Kilpatrick Townsend & Stockton, LLP

(57) ABSTRACT

A ratcheting setting tool can use wellbore fluid to inflate expandable seals positioned downhole in a wellbore. For example, the ratcheting setting tool can include a piston within a first chamber. The piston can move from a first position to a second position in the first chamber when a pressure is applied to the piston. The ratcheting setting tool can include a first check valve in a second chamber. The first check valve can transmit wellbore fluid from the wellbore into the second chamber. The ratcheting setting tool can include a second check valve. The second check valve can transmit the wellbore fluid in the second chamber into an inflatable valve when the piston moves from the first position to the second position. In some examples, the ratcheting setting tool may be a hydraulic ratchet.

20 Claims, 5 Drawing Sheets

(56) References Cited

U.S. PATENT DOCUMENTS

| | | | | |
|---|---|---|---|---|
| 5,400,855 | A * | 3/1995 | Stepp | E21B 33/127 166/151 |
| 5,429,036 | A | 7/1995 | Latos | |
| 6,073,708 | A | 6/2000 | Brown et al. | |
| 6,289,998 | B1 | 9/2001 | Krueger et al. | |
| 7,000,705 | B2 | 2/2006 | Buyers et al. | |
| 7,614,454 | B2 | 11/2009 | Buyers et al. | |
| 9,309,745 | B2 | 4/2016 | Patel | |
| 9,383,029 | B2 | 7/2016 | Bruce | |
| 9,551,200 | B2 | 1/2017 | Read et al. | |
| 10,066,466 | B2 | 9/2018 | Radtke | |
| 10,132,135 | B2 | 11/2018 | Gaude | |
| 2005/0011678 | A1 | 1/2005 | Akinlade et al. | |
| 2010/0243234 | A1 | 9/2010 | Saltel | |
| 2011/0232474 | A1 | 9/2011 | Geiger | |
| 2014/0190708 | A1 | 7/2014 | Hallundbaek | |
| 2014/0216755 | A1 | 8/2014 | Hallundæk et al. | |
| 2016/0024897 | A1* | 1/2016 | Greci | E21B 43/108 166/227 |
| 2016/0160850 | A1 | 6/2016 | Fisher et al. | |
| 2017/0321515 | A1 | 11/2017 | Stæhr | |
| 2017/0343019 | A1 | 11/2017 | Thomson et al. | |
| 2021/0047893 | A1 | 2/2021 | Hrupp et al. | |
| 2022/0090457 | A1 | 3/2022 | Tanguy et al. | |
| 2022/0186579 | A1* | 6/2022 | Pelto | E21B 23/06 |
| 2023/0272685 | A1* | 8/2023 | Dave | E21B 23/06 |
| 2023/0304374 | A1* | 9/2023 | Eldho | E21B 33/1293 |

FOREIGN PATENT DOCUMENTS

| | | | |
|---|---|---|---|
| GB | 2552994 | A | 2/2018 |
| WO | 9935365 | A2 | 7/1999 |
| WO | 2016051180 | A1 | 4/2016 |
| WO | 2018033708 | A1 | 2/2018 |

OTHER PUBLICATIONS

Halliburton Energy Services, Inc , "Endurance Hydraulic Screen ©", YouTube video, posted on Halliburton's channel and available at https://www.youtube.com/watch?v=hKkSMAOm8A4, 2021, 1 page (website screenshot submitted).

Saltel Industries , "Expandable Steel Packer for Improving Primary Cementing", YouTube video, posted onSaltel's channel and available at https://www.youtube.com/watch?v=OY5pbjnh-iY, Apr. 19, 2019, 1 page (website screenshot submitted).

Unpublished U.S. Appl. No. 19/253,406, filed Jun. 27, 2025, by Halliburton Energy Services Inc., Jun. 27, 2025.

Bartnicki et al., "The Research of Hydraulic Pressure Intensifier for use in Electric Drive System", Institute of Electrical and Electronics Engineers Access, vol. 7, Feb. 2019, 6 pages.

* cited by examiner

RATCHETING SETTING TOOL FOR AN EXPANDABLE SEAL IN A WELLBORE

TECHNICAL FIELD

The present disclosure relates generally to wellbore operations and, more particularly (although not necessarily exclusively), to setting expandable seals in a wellbore.

BACKGROUND

During a completion phase of a hydrocarbon well, an open hole well zone (or interval) of interest may be isolated from a remainder of the hydrocarbon well for various reasons. Isolating an open hole well interval of interest is commonly accomplished using expandable, spaced apart seals. Expandable seals can be positioned on a tool string that can be used to run the expandable seals to a desired downhole location. After the expandable seals are positioned at the desired downhole location, the expandable seals may be expanded to isolate the well interval located between the expandable seals from fluid and pressure in other portions of the well.

DETAILED DESCRIPTION

Figure 1:
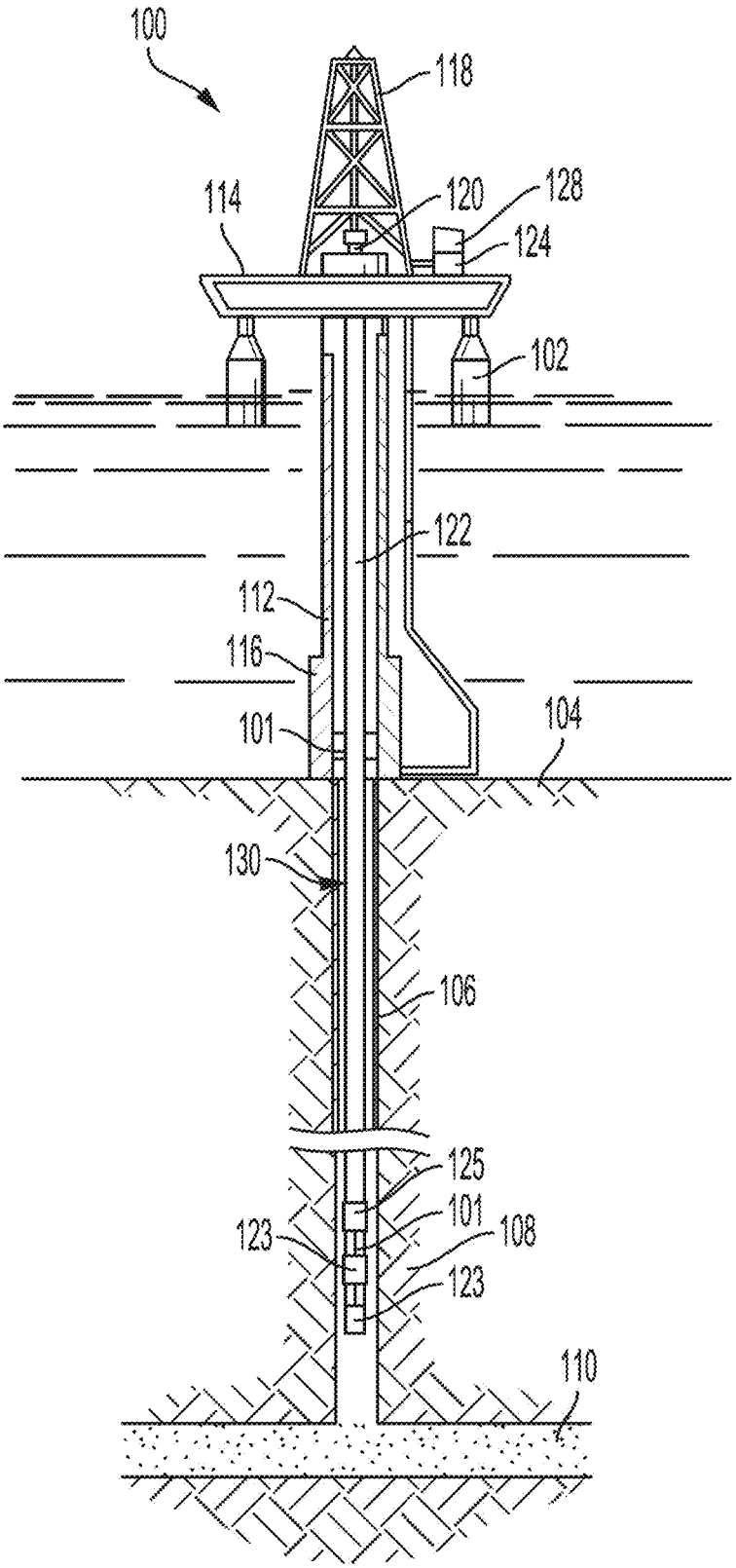
FIG. 1 is a cross-sectional view of a wellbore environment including a ratcheting setting tool used to set expandable seals, according to an example of the present disclosure.

Certain aspects and examples of the present disclosure relate to a ratcheting setting tool that can transfer wellbore fluid into downhole expandable seals such as packers or activation chambers for hydraulic screens. A ratcheting setting tool may be a hydraulic ratchet that can repeatedly actuate (e.g., in a linear direction) in successive pressure cycles to push wellbore fluid into an expandable seal. The ratcheting setting tool can include a piston that can be moved from a first position to a second position when a pressure is applied from a surface of a wellbore. When the piston moves to the second position, the piston can apply pressure to wellbore fluid in a chamber of the ratcheting setting tool. The wellbore fluid can enter the chamber via a first check valve to the annulus of the wellbore. When the piston applies pressure to the wellbore fluid, the wellbore fluid can be forced into an expandable seal via a second check valve, thus inflating the expandable seal. Because the second check valve can prevent the wellbore fluid from exiting the expandable seal, the pressure in the chamber can drop after the wellbore fluid is transferred. This drop in pressure can cause the piston to move back to the first position. The drop in pressure can also cause additional wellbore fluid to be transferred from the annulus and into the chamber. As the ratcheting setting tool is now reset, these operations (applying pressure from the surface, moving the piston, transferring the wellbore fluid into the expandable seal) can be repeated until the expandable seal is fully inflated with wellbore fluid.

Some expandable seals, such as packers, may require a considerable volume of fluid and relatively high pressures in order to fully inflate. For instance, some packers may require up to 8,000 psi to fully inflate. Some surface equipment may not be compatible with such high pressures. Other devices in a completion string, such as sleeves, may shear open at pressures less than 8,000 psi (e.g., before the packer is fully set), which may lead to well control issues. In some cases, cup tools may be used to isolate an inlet port of a packer. But this may not address issues related to the high pressures required to fully inflate the packer. Additionally, running a cup tool downhole may be time-consuming, as each packer on the completion string may need to be isolated in separate operations. In some cases, a completion string may have up to fifty packers and it may take several days to isolate all fifty packers.

Because the ratcheting setting tool described herein is resettable, the ratcheting setting tool can apply pressure cycles of a lower pressure (e.g., 2,000 psi) a number of times (e.g., in three cycles) to fully inflate a packer. Applying lower pressure cycles can prevent well control issues caused by high downhole pressures. Further, the ratcheting setting tool can be coupled to multiple packers downhole via a control line. Alternatively, each downhole device, such as but not limited to a packer or screen, may have its own ratcheting setting tool that can all be activated simultaneously by applying pressure through the tubing, the annulus, or both, as a tubing to annulus differential pressure need not be generated. Thus, the ratcheting setting tool may simultaneously inflate multiple packers, significantly reducing the amount of time needed to set packers downhole.

The ratcheting setting tool can similarly be used to set expandable hydraulic screens. As some hydraulic screens have a perforated base pipe, a tubing/annulus pressure differential may not be possible. Typically, slickline runs with cup packers can be run to set the hydraulic screens in groups of two, which can be time-consuming. Because the ratcheting setting tool can be directly attached to the expandable seals and may not depend on tubing to annulus differential for activation, the necessary pressure differential can be created that can allow the expandable seals to expand the hydraulic screens against the wellbore. Thus, by using the ratcheting setting tool described herein, a perforated base pipe with hydraulic screens can be deployed downhole as quickly as a solid base pipe with hydraulic screens.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a cross-sectional view of a wellbore environment 100 including a ratcheting setting tool used to set expandable seals, according to an example of the present disclosure. A floating workstation 102 (e.g., an oil platform or an offshore platform) can be centered over a submerged oil or gas well located in a sea floor 104 having a wellbore 106.

The wellbore 106 may extend from the sea floor 104 through a subterranean formation 108. The subterranean formation 108 can include a fluid-bearing formation 110. A subsea conduit 112 can extend from the deck 114 of the floating workstation 102 into a wellhead installation 116. The floating workstation 102 can have a derrick 118 and a hoisting apparatus 120 for raising and lowering tools to drill, test, and complete the oil or gas well. The floating workstation 102 can be an oil platform as depicted in FIG. 1 or an aquatic vessel capable of performing the same or similar drilling and testing operations. In some examples, the process described herein can be applied to a land-based environment for wellbore exploration, planning, drilling, and completion.

A tubing string 122 can be lowered into the wellbore 106 of the oil or gas well as part of a completion operation of the oil or gas well. Downhole fluids, such as production fluids, can flow through a flow path defined by the tubing string 122. The tubing string 122 can include one or more downhole tools usable downhole. The downhole tools can include wellbore stimulation equipment, production equipment, sand control tools, packers, retrievable tools, flow control devices, or any other suitable downhole tools. In the example depicted in FIG. 1, the downhole tools can include expandable seal 123 (e.g., packers). The tubing string 122 can additionally include a ratcheting setting tool 125 that can be used to mechanically deform the expandable seal 123. The ratcheting setting tool 125 can use a pressure multiplier (also sometimes known as a pressure intensifier) and piston travel to pump wellbore fluid into the expandable seals 123. The wellbore fluid can include drilling fluid (e.g., drilling mud), brine, water, or any other suitable wellbore fluid. The ratcheting setting tool 125 may be a hydraulic ratchet that can pump the wellbore fluid into the expandable seals 123 over multiple cycles. By varying and cycling tubing pressure, a bicycle pump-like action can be achieved via the ratcheting setting tool 125 to inflate the expandable seals 123 over multiple cycles.

In some examples, the ratcheting setting tool 125 can simultaneously inflate multiple expandable seals 123 in a single operation. For example, the setting tool 125 can be coupled to each expandable seal 123 using a control line 101. The ratcheting setting tool 125 can pump wellbore fluid through the control line 101 to multiple expandable seals 123 simultaneously (e.g., in a single pressure cycle). Alternatively, each downhole device can have its own ratcheting setting tool and pressure cycles through the tubing or annulus or both can activate each ratcheting setting tool simultaneously.

Figure 2:
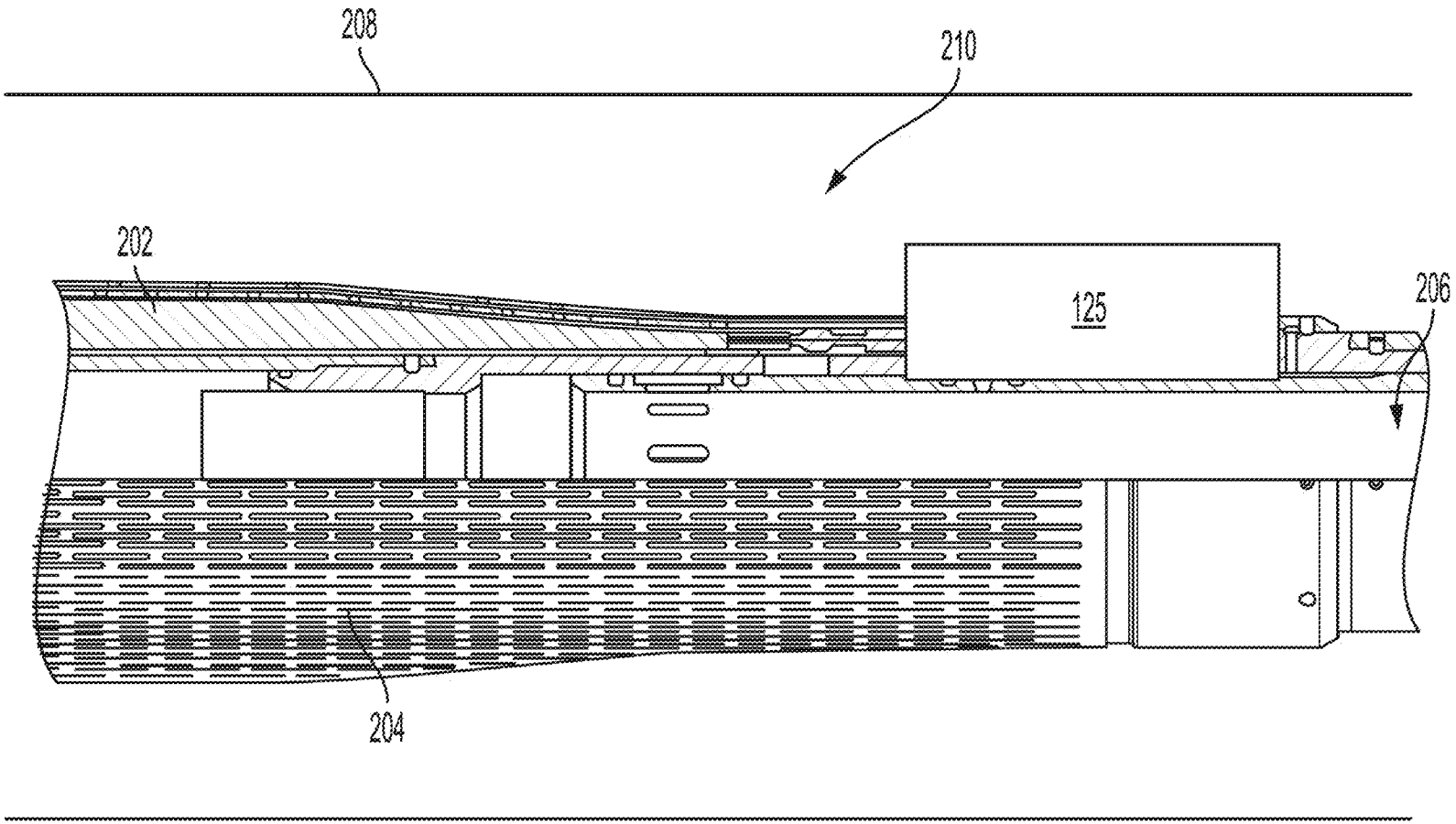
FIG. 2 is a cross-sectional view of an activation chamber for a hydraulic screen that is expanded by a ratcheting setting tool, according to an example of the present disclosure.

FIG. 2 is a cross-sectional view of an activation chamber 202 for a hydraulic screen 204 that is expanded by a ratcheting setting tool 125, according to an example of the present disclosure. The activation chamber 202 can be an example of an expandable seal (e.g., the expandable seal 123 of FIG. 1). When the activation chamber 202 is expanded, the activation chamber 202 can expand the hydraulic screen 204 (e.g., to conform against a wellbore 208). In some examples, the activation chamber 202 and hydraulic screen 204 may be coupled to a perforated base pipe 206. Perforations in the perforated base pipe 206 may prevent pressurization of fluid in the perforated base pipe 206, preventing such fluid from inflating the activation chamber 202. Typically, slickline runs may be performed to individually set isolation seals in order to inflate the activation chamber 202. But this may be time consuming and labor intensive.

Instead, the ratcheting setting tool 125 can be used to draw in wellbore fluid (e.g., from an annulus 210 between the wellbore 208 and the perforated base pipe 206 or from the perforated base pipe 206). As the perforated base pipe 206 is run downhole, wellbore fluid may be drawn into the activation chamber 202 to equalize a downhole pressure and a pressure inside the activation chamber 202. After the perforated base pipe 206 has reached a desired position downhole, the ratcheting setting tool 125 can use pressure intensification (e.g., via a piston and in response to pressure applied from a surface of the wellbore 208) to cause additional wellbore fluid to enter the activation chamber 202. The ratcheting setting tool 125 can reset after each pressure cycle, allowing the activation chamber 202 to be expanded in multiple pressure cycles. The expanded activation chamber 202 can thus expand the hydraulic screen 204 against the wellbore 208. The reset mechanism after each pressure cycle may ensure that the ratcheting setting tool 125 need not be long enough to carry the entire volume of fluid needed for activation in a single stroke of the ratcheting setting tool 125.

Figure 3:
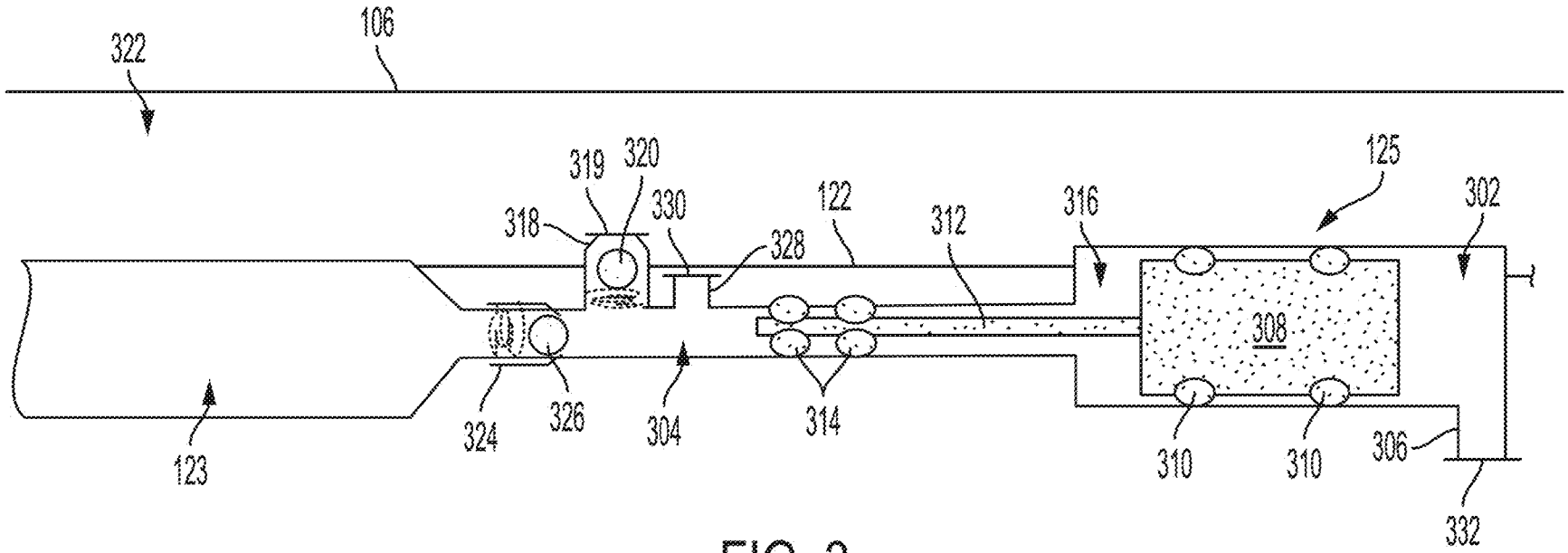
FIG. 3 is a cross-sectional diagram of a ratcheting setting tool in a first position, according to an example of the present disclosure.

FIG. 3 is a cross-sectional diagram of a ratcheting setting tool 125 in a first position, according to an example of the present disclosure. The ratcheting setting tool 125 can be attached to an expandable seal 123 (e.g., a packer, the activation chamber 202 of FIG. 2, or any suitable inflatable element used downhole in a wellbore). The ratcheting setting tool 125 and the expandable seal 123 can be attached to a tubing string 122 in a wellbore 106.

The ratcheting setting tool 125 can include a first chamber 302 and a second chamber 304. The first chamber 302 may have a larger diameter than the second chamber 304. This larger diameter can be used to intensify a pressure that is applied from a surface of the wellbore 106. The first chamber 302 may have a first port 306 that can receive the pressure applied from the surface of the wellbore 106. The ratcheting setting tool 125 can include a piston 308 within the first chamber 302. In some examples, the ratcheting setting tool 125 can include one or more seals 310 (e.g., an O-ring) between the piston 308 and the walls of the first chamber 302. The seals 310 can prevent the surface pressure received via the first port 306 from leaking through the first chamber 302 and into the second chamber 304.

The piston 308 can include an extension piece 312 that can extend into the second chamber 304. In some examples, the ratcheting setting tool 125 can include one or more seals 314 (e.g., O-rings) between the extension piece 312 and the walls of the second chamber 304. The seals 314 can prevent a pressure in a volume 316 between the seals 314 and the piston 308 from leaking into a remainder of the second chamber 304. In some examples, the piston 308 and extension piece 312 can contain a nitrogen gas spring. That is, the volume 316 may include a compressible gas or fluid such as nitrogen. In other examples, the piston 308 and extension piece 312 may support a compressible mechanical spring.

In some examples, the second chamber 304 can include an annulus port 318 to an annulus 322 between the tubing string 122 and the wellbore 106. In other examples, the second chamber 304 can include an annulus port 318 to the tubing string 122. The annulus 322 and the tubing string 122 can include wellbore fluid (e.g., drilling mud pumped from a surface of the wellbore 106, water, hydrocarbons, or any suitable wellbore fluid). A first check valve 320 can be positioned in the annulus port 318. The first check valve 320 can allow wellbore fluid (e.g., from the annulus 322 or from the tubing string 122) to enter the second chamber 304 via the annulus port 318. But the first check valve 320 may not allow wellbore fluid to exit the second chamber 304 via the annulus port 318. In some examples, the annulus port 318 can include a screen 319 or a mechanical filter that can cleanse the wellbore fluid before the wellbore fluid enters the first check valve 320. The screen 319 can filter out relatively large particles that may otherwise get caught in the first check valve 320. Additionally or alternatively, the ratcheting setting tool 125 may include an additional fluid chamber (e.g., coupled to the first check valve 320) that can transfer wellbore fluid chamber into the second chamber 304. For example, a control line (e.g., the control line 101 of FIG. 1) may transfer wellbore fluid into the additional fluid chamber.

The second chamber 304 can also include a second port 324 that couples the ratcheting setting tool 125 to the expandable seal 123. A second check valve 326 can be positioned in the second port 324. The second check valve 326 can allow wellbore fluid in the second chamber 304 to enter the expandable seal 123 via the second port 324. But the second check valve 326 may not allow wellbore fluid to exit the expandable seal 123 via the second port 324. Thus, wellbore fluid can be transferred into the expandable seal 123 and can remain in the expandable seal 123 to cause an expansion of the expandable seal 123. In some examples, the first check valve 320 and the second check valve 326 can include a ceramic ball and a polytetrafluoroethylene (PTFE) seat that can seal the ceramic ball.

In some examples, the ratcheting setting tool 125 may include one or more rupture disks. For example, the ratcheting setting tool 125 may include a first rupture disk 332 on the first port 306 of the first chamber 302. The first rupture disk 332 can rupture if downhole pressure exceeds a rupture threshold. In some examples, the tubing string 122 may be moved up and down or in and out of the wellbore 106 several times in the process of setting the tubing string 122 downhole. In some examples, this may increase a downhole pressure applied to the ratcheting setting tool 125, causing the ratcheting setting tool 125 to prematurely transfer wellbore fluid into the expandable seal 123 to expand the expandable seal 123. Placing the first rupture disk 332 on the first port 306 can prevent the ratcheting setting tool 125 from premature operations. When the tubing string 122 is set downhole, a pressure can be applied from the surface of the wellbore 106 that can rupture the first rupture disk 332, thus allowing the ratcheting setting tool 125 to be used to expand the expandable seal 123.

Additionally, in some examples, the second chamber 304 may have a second annulus port 328 to the annulus 322 or the tubing string 122. The second annulus port 328 may have a second rupture disk 330 that can rupture when pressure within the second chamber 304 exceeds a rupture threshold. In some examples, the rupture threshold for the second rupture disk 330 may be higher than a rupture threshold for the first rupture disk 332. The second rupture disk 330 may be beneficial for activation chambers used to expand hydraulic screens, as in some examples, such hydraulic screens may not have an activation limiter. Rupturing the second rupture disk 330 may cause wellbore fluid from the annulus 322 or the tubing string 122 to enter the second chamber 304. This can cause the pressure inside the second chamber 304 to equalize with the pressure in the annulus 322 or the tubing string 122 permanently by opening a permanent flow path between the second chamber 304 and the tubing string 122 or annulus 322. Hence, no further activation of the expandable seal 123 may be possible, thereby ensuring that the expandable seal 123 is not over pressured or otherwise over activated.

As depicted in FIG. 3, before operation, the piston 308 of the ratcheting setting tool 125 may be positioned in a first position. That is, the first position can involve the piston 308 being set at a distance away from a leftmost wall of the first chamber 302. In a non-limiting example, the downhole pressure in the annulus 322 can be 3,000 psi. As the tubing string 122 is run downhole, the first check valve 320 can allow wellbore fluid to enter the second chamber 304 until a pressure inside the second chamber 304 equalizes to the pressure outside the second chamber 304 (e.g., 3,000 psi). Similarly, the second check valve 326 can allow the wellbore fluid inside the second chamber 304 to transfer into the expandable seal 123 until the pressure inside the expandable seal 123 equalizes (e.g., to 3,000 psi). This may not yet cause an inflation of the expandable seal 123, as the pressure inside and outside of the expandable seal 123 may be equal. The pressure in the first chamber 302 (e.g., to the right of the piston 308) can also be 3,000 psi. The pressure in the volume 316 between the seals 314 and the piston 308, which may include a compressible gas or fluid (e.g., nitrogen) or a mechanical spring, can also be 3,000 psi. Pressure can be applied from uphole to actuate the ratcheting setting tool 125 to inflate the expandable seal 123.

For example, upon the tubing string 122 reaching a desired depth, the pressure for the tubing string 122 and annulus 322 can be increased by 500 psi. Because there is not a need to create a pressure differential between the tubing string 122 and the annulus 322, the pressure can be applied across the entire wellbore (e.g., including within the tubing string 122). Thus, the pressure in the annulus 322 can be 3,500 psi and the pressure in the first chamber 302 can be 3,500 psi. The cross-sectional area of the first chamber 302 can be greater than the cross-sectional area of the second chamber 304. For example, the cross-sectional area of the first chamber 302 may be double the cross-sectional area of the second chamber 304. This difference in areas can cause a pressure multiplier effect on the wellbore fluid in the second chamber 304. For example, the additional 500 psi of pressure applied downhole and inside the first chamber 302 can be converted to 1,000 psi of pressure applied to the left side of the piston 308 and extension piece 312 (e.g., in the second chamber because the area of the first chamber 302 is double the area of the second chamber 304. Additionally, the 500 psi of pressure applied to the piston 308 can move the piston 308 from the first position to a second position.

Figure 4:
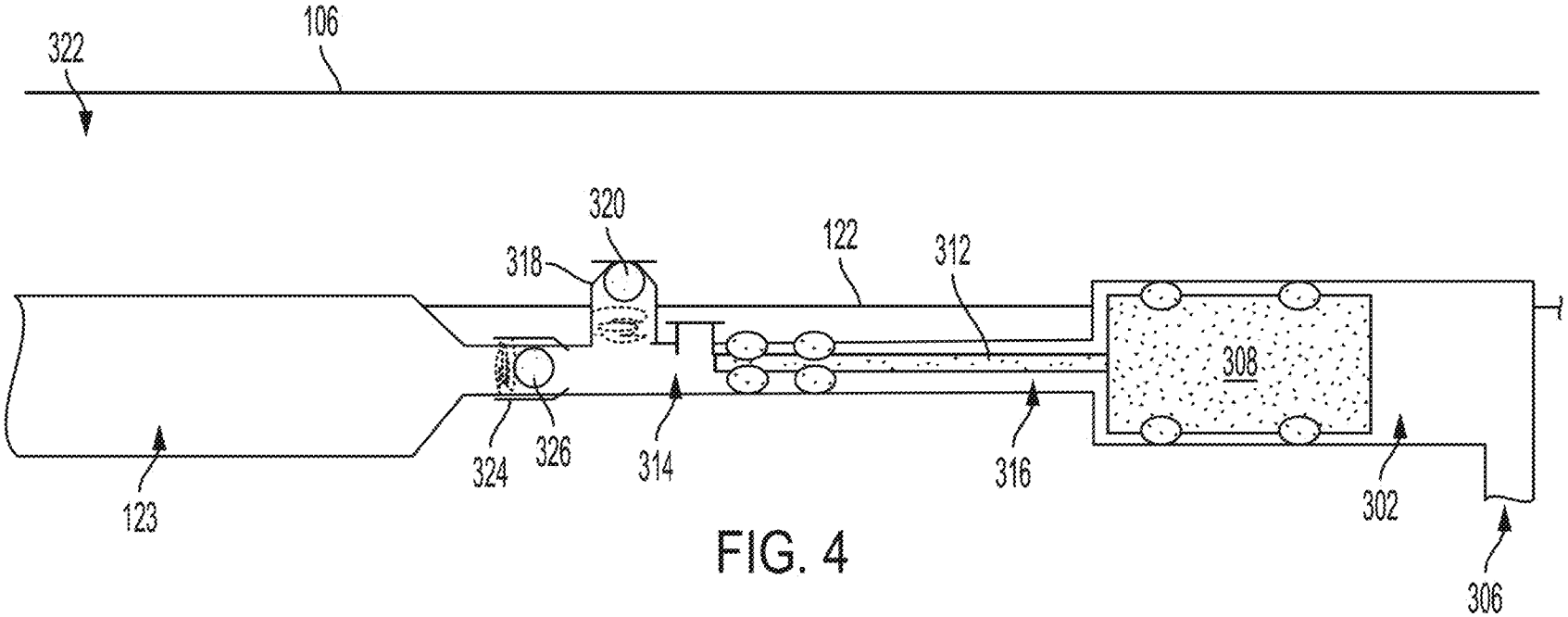
FIG. 4 is a cross-sectional diagram of the ratcheting setting tool of FIG. 4 in a second position, according to an example of the present disclosure.

FIG. 4 is a cross-sectional diagram of the ratcheting setting tool of FIG. 4 in a second position, according to an example of the present disclosure. The second position can involve the leftmost side of the piston 308 contacting the leftmost wall of the first chamber 302. In other words, the entire extension piece 312 may be positioned within the second chamber 304 when the piston 308 is in the second position. Continuing the non-limiting example introduced above, the pressure within the second chamber 304 can be 4,000 psi due to the piston 308 moving to the second position and due to the pressure multiplier effect caused by the difference in cross-sectional area between the first chamber 302 and the second chamber 304.

Increasing the pressure in the second chamber 304 to 4,000 psi while the pressure in the annulus 322 remains at 3,500 psi can cause the first check valve 320 to close. Closing the first check valve 320 can prevent wellbore fluid from the annulus 322 from flowing into the second chamber 304 via the annulus port 318. As the pressure inside the second chamber 304 is now 4,000 psi while the pressure inside the expandable seal 123 is 3,000 psi, this pressure differential may cause the second check valve 326 to open. Opening the second check valve 326 can push the wellbore fluid in the second chamber 304 into the expandable seal 123 via the second port 324 until the pressure inside the expandable seal 123 equalizes with the pressure in the second chamber 304 (e.g., to 3,500 psi). Because the second check valve 326 can prevent wellbore fluid from flowing out of the expandable seal 123, the additional wellbore fluid can cause the expandable seal 123 to expand.

Once wellbore fluid has been pushed into the expandable seal 123, the pressure inside the second chamber 304 may be 3,500 psi. The 500 psi of pressure applied from uphole may cease. This can cause the pressure in the annulus 322, the tubing string 122, and the first chamber 302 to return to the initial downhole pressure (e.g., 3,000 psi). Because the pressure to the left of the piston 308 and extension piece 312 (e.g., 3,500 psi) is greater than the pressure to the right of the piston 308, and because of energy stored in a mechanical spring or a compressible fluid spring in the volume 316, the piston 308 can be pushed back to the first position.

Pushing the piston 308 back to the first position can cause a pressure drop in the second chamber 304. The piston 308 may be pushed back to the first position due to the force from the gas spring in volume 316, a mechanical spring in volume 316, or due to a reduction in the downhole pressure. For example, the pressure in the second chamber 304 may drop to 2,500 psi. The pressure in the annulus may be 3,000 psi. This pressure differential can cause the first check valve 320 to open. The open first check valve 320 can allow additional wellbore fluid to enter the second chamber 304 from the annulus 322 via the annulus port 318 until the pressure inside the second chamber 304 equalizes with the pressure outside the second chamber 304 (e.g., to 3,000 psi). Thus, the ratcheting setting tool 125 can be fully reset to the first position to be used in a second pressure cycle (e.g., applying pressure from the surface of the wellbore 106 to transfer wellbore fluid into the expandable seal 123). Pressure cycles can be repeated until the expandable seal 123 is fully inflated. For example, wellbore fluid may be transferred into the expandable seal 123 until there is a pressure differential of 750 psi between the expandable seal 123 and the annulus 322. Thus, the expandable seal 123 may be inflated solely with surface equipment and without the use of a slickline rig or crew.

The number of pressure cycles and the amount of pressure applied from uphole in each pressure cycle can depend on the size of the ratcheting setting tool 125, the size of the expandable seal 123, and the number of expandable seals 123 connected to the ratcheting setting tool 125 (e.g., via a control line connected to inlet ports of the expandable seals 123). If the tubing string 122 includes tools with pressure limits (e.g., sleeves) or if the wellbore cannot support high applied pressure (e.g., fracturing of the formation), then the uphole pressure may be relatively low (e.g., below the pressure limits), and an increased number of pressure cycles may be performed to fully inflate the expandable seal 123. Alternatively, a larger area ratio between first chamber 302 and second chamber 304 may be utilized. As a non-limiting example, a ratio of 4:1 can intensify the applied pressure by 4 times. One skilled in the art will recognize that the ratio of areas and the size of the tool can be modified to suit different applications and requirements without departing from the scope of the invention.

Figure 5:
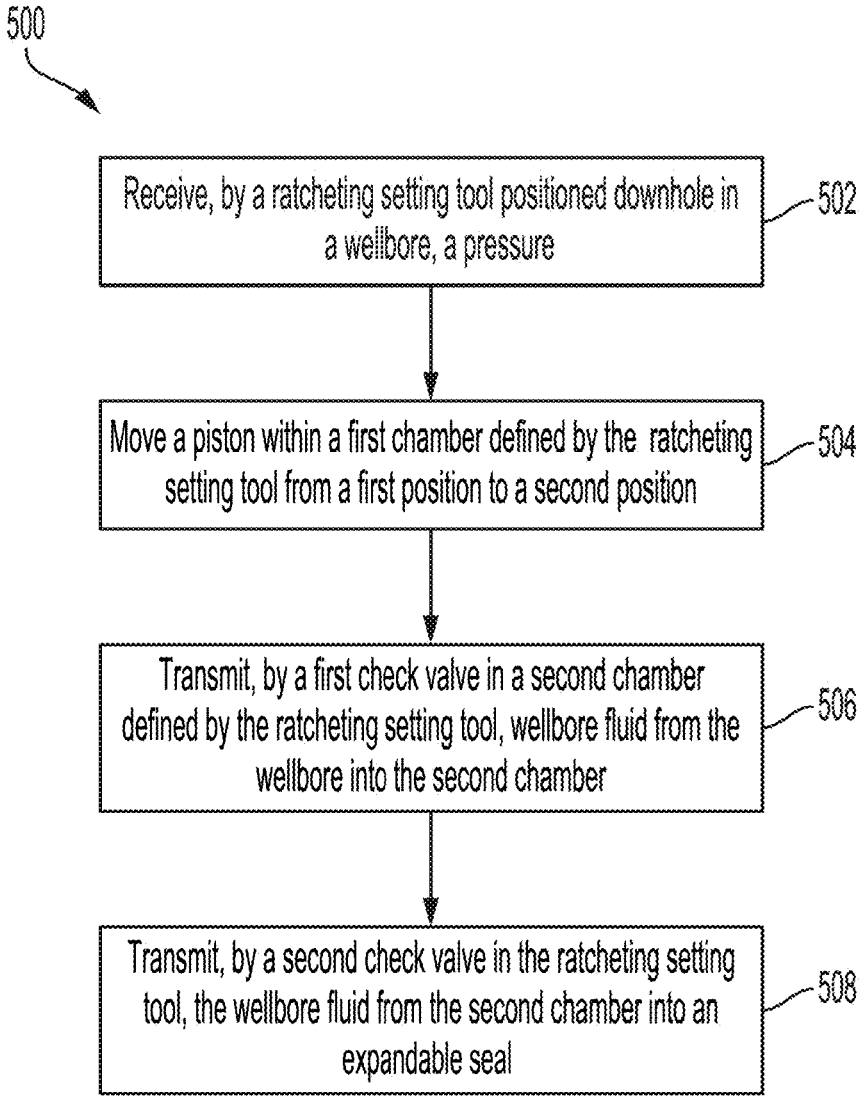
FIG. 5 is a flow chart representing a method for using a ratcheting setting tool to transfer wellbore fluid into an expandable seal in a wellbore, according to an example of the present disclosure.

FIG. 5 is a flow chart representing a process 500 for using a ratcheting setting tool 125 to transfer wellbore fluid into an expandable seal 123 in a wellbore 106, according to an example of the present disclosure. The steps of process 500 may be described with reference to components discussed above with respect to FIGS. 1-4. Some of the following steps may be performed in any order with respect to the other steps as would be understood by one of ordinary skill in the art.

At block 502, a ratcheting setting tool 125 positioned downhole in a wellbore 106 can receive a pressure (e.g., a first pressure) applied from a surface of the wellbore 106. The ratcheting setting tool 125 can be a hydraulic ratchet. The ratcheting setting tool 125 can define a first chamber 302 and a second chamber 304. The pressure can be received at a first port 306 of the first chamber 302. The first chamber 302 can include the first port 306 and a piston 308 with an extension piece 312 that can extend into the second chamber 304. A second port 324 in the second chamber 304 can couple the ratcheting setting tool 125 to an expandable seal 123. Prior to receiving the first pressure applied from the surface of the wellbore 106, the internal pressure of the first chamber 302, the second chamber 304, and the expandable seal 123 may be equalized to a downhole pressure in an annulus 322 of the wellbore 106 external to the ratcheting setting tool 125 and the expandable seal 123. Applying the first pressure from the surface of the wellbore 106 can cause a pressure within the first chamber 302 to be greater than a pressure within the second chamber 304.

At block 504, a piston 308 within the first chamber 302 defined by the ratcheting setting tool 125 can be moved from a first position to a second position in response to receiving the first pressure. Moving from the first position to the second position may involve moving the piston 308 towards the second chamber 304, thus applying a second pressure to increase a pressure within the second chamber 304. In some examples, a cross-sectional area of the first chamber 302 may be larger than a cross-sectional area of the second chamber 304. This can cause a pressure multiplier effect on the first pressure applied from the surface of the wellbore 106. For example, if the first pressure applied from the surface is 500 psi and the cross-sectional area of the first chamber 302 is double the cross-sectional area of the second chamber 304, moving the piston 308 from the first position to the second position may cause double the amount of first pressure from the surface to be applied to the second chamber 304 (e.g., 1,000 psi as a second pressure).

At block 506, a first check valve 320 of the second chamber 304 defined by the ratcheting setting tool 125 can transmit wellbore fluid from the annulus 322 of the wellbore 106 into the second chamber 304. The first check valve 320 may be positioned in an annulus port 318 of the second chamber 304. The annulus port 318 may be a port to the annulus 322 or to the tubing string 122. The first check valve 320 may allow wellbore fluid to flow into the second chamber 304 but may prevent wellbore fluid from flowing out of the second chamber 304. Thus, when a pressure inside the second chamber 304 is less than a downhole pressure in the wellbore 106, the first check valve 320 may open and wellbore fluid can flow into the second chamber 304. When the pressure inside the second chamber 304 is greater than a downhole pressure in the wellbore 106, the first check valve 320 may close and wellbore fluid may not flow into the second chamber 304.

At block 508, a second check valve 326 in the ratcheting setting tool 125 can transmit the wellbore fluid from the second chamber 304 into the expandable seal 123 in response to the piston 308 moving from the first position to the second position. The second check valve 326 can be positioned within the second port 324 that couples the ratcheting setting tool 125 to the expandable seal 123. Moving the piston 308 to the second position can apply a second pressure to the second chamber 304, thus increasing the pressure. The second chamber 304 can then have a higher internal pressure than a pressure within the expandable seal 123. This pressure differential can cause the second check valve 326 to open, allowing the wellbore in the second chamber 304 to transfer into the expandable seal 123. The second check valve 326 may not allow wellbore fluid to transfer out of the expandable seal 123. Thus, the wellbore fluid transferred into the expandable seal 123 in response to the piston 308 moving to the second position may remain in the expandable seal 123.

In some examples, after the second check valve 326 transmits the wellbore fluid into the expandable seal 123, the piston 308 can move back to the first position from the second position. The piston 308 may include a spring storing energy that causes the piston 308 to move back to the first position. When the piston 308 moves back to the first position, this can create a vacuum effect in the second chamber 304. For example, the pressure within the second chamber 304 can drop to be lower than the downhole pressure in the annulus 322 or the tubing string 122. This can cause the first check valve 320 to open, allowing additional wellbore fluid from the annulus 322 or the tubing string 122 to be transmitted into the second chamber 304. The ratchetting setting tool 125 can therefore be reset to an initial position to be used in further pressure cycles.

In some examples, at least three pressure cycles may be performed by the ratcheting setting tool 125 to mechanically deform (e.g., inflate or expand) the expandable seal 123, as a single cycle may be insufficient to fully set the expandable seal 123. In some examples, up to fifty pressure cycles may be performed by the ratcheting setting tool 125 to set the expandable seal 123. For example, the ratcheting setting tool 125 may perform up to five, up to ten, up to fifteen, up to twenty, up to twenty-five, up to thirty, up to thirty-five, up to forty, up to forty-five, or up to fifty pressure cycles to set the expandable seal 123. In some examples, performance of a single pressure cycle by the ratcheting setting tool 125 may take between one minute and fifty minutes. For example, a single pressure cycle may take between one minute and five minutes, between five minutes and ten minutes, between ten minutes and fifteen minutes, between fifteen minutes and twenty minutes, between twenty minutes and twenty-five minutes, between twenty-five minutes and thirty minutes, between thirty minutes and thirty-five minutes, between thirty-five minutes and forty minutes, or between forty-five minutes and fifty minutes.

In some examples, the ratcheting setting tool 125 may be coupled to multiple expandable seals (e.g., packers or activation chambers) via a control line 101. The control line 101 can transmit wellbore fluid from the second chamber 304 into the additional packers or activation chambers. The ratchetting setting tool 125 can therefore be used to simultaneously inflate multiple packers or activation chambers at the same time.

In some aspects, system, method, and apparatus for transferring wellbore fluid into downhole expandable seals are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: an expandable seal positionable downhole in a wellbore; and a ratcheting setting tool comprising: a piston positionable within a first chamber defined by the ratcheting setting tool, the piston movable from a first position to a second position within the first chamber in response to a pressure; a first check valve configured to transmit wellbore fluid from the wellbore into a second chamber defined by the ratcheting setting tool; and a second check valve configured to transmit wellbore fluid from the second chamber into the expandable seal in response to the piston moving from the first position to the second position.

Example 2 is the system of example(s) 1, wherein the ratcheting setting tool further comprises: an extension piece extending from the piston into the second chamber; a first seal coupleable to the piston in the first chamber; and a second seal coupleable to the extension piece in the second chamber, wherein the ratcheting setting tool is a hydraulic ratchet.

Example 3 is the system of any of example(s) 1-2, wherein the expandable seal is a first expandable seal on a tubing string deployable downhole in the wellbore, and wherein the system further comprises: a control line couplable at a first end to a third port of the second chamber and at a second end to an inlet port of a second inflatable packer, the control line configurable to transfer wellbore fluid into the second inflatable packer via the inlet port.

Example 4 is the system of any of example(s) 1-3, wherein the expandable seal is positionable between an outer surface of a perforated tubing string and a hydraulic screen, and wherein the expandable seal is configurable to expand the hydraulic screen in the wellbore.

Example 5 is the system of any of example(s) 1-4, wherein the ratcheting setting tool further comprises: a first port in the first chamber configured to receive the pressure; an annulus port in the second chamber, wherein the first check valve is positioned in the annulus port; and a second port in the second chamber coupleable to the expandable seal, wherein the second check valve is positioned in the second port.

Example 6 is the system of any of example(s) 1-5, further comprising: a first rupture disk positionable on the first port of the ratcheting setting tool.

Example 7 is the system of any of example(s) 1-6, wherein the annulus port is a first annulus port, and wherein the system further comprises: a second rupture disk positionable on a second annulus port of the second chamber.

Example 8 is a method comprising: receiving, by a ratcheting setting tool positioned downhole in a wellbore, a pressure; moving a piston within a first chamber defined by the ratcheting setting tool from a first position to a second position in response to receiving the pressure; transmitting, by a first check valve in a second chamber defined by the ratcheting setting tool, wellbore fluid from the wellbore into the second chamber; and transmitting, by a second check valve in the ratcheting setting tool, the wellbore fluid from the second chamber into an expandable seal in response to the piston moving from the first position to the second position.

Example 9 is the method of example(s) 8, wherein the ratcheting setting tool is a hydraulic ratchet, wherein the pressure is a first pressure, and wherein the method further comprises: applying, by the piston, a second pressure to the wellbore fluid in the second chamber in response to the first pressure being applied from a surface of the wellbore, wherein the second pressure is greater than the first pressure.

Example 10 is the method of any of example(s) 8-9, further comprising: moving, by the piston, from the second position to the first position subsequent to the second check valve transmitting the wellbore fluid from the second chamber into the expandable seal; and transmitting, by the first check valve, additional wellbore fluid into the second chamber in response to the piston moving from the second position to the first position.

Example 11 is the method of any of example(s) 8-10, wherein the expandable seal is a first expandable seal on a tubing string deployed downhole in the wellbore, and wherein the method further comprises: transmitting, by a control line, the wellbore fluid from the second chamber of the ratcheting setting tool and into a second expandable seal.

Example 12 is the method of any of example(s) 8-11, further comprising: expanding the expandable seal in response to transmitting the wellbore fluid from the second chamber into the expandable seal; and expanding a hydraulic screen surrounding the expandable seal against the wellbore in response to expanding the expandable seal.

Example 13 is the method of any of example(s) 8-12, further comprising: rupturing a first rupture disk positioned on a first port in the first chamber in response to a downhole pressure of the wellbore exceeding a rupture threshold.

Example 14 is the method of any of example(s) 8-13, further comprising: rupturing a second rupture disk on a second port in the second chamber in response to a downhole pressure of the wellbore exceeding a rupture threshold.

Example 15 is a ratcheting setting tool comprising: a piston positionable within a first chamber defined by the ratcheting setting tool that is positionable downhole in a wellbore, the piston movable from a first position to a second position within the first chamber in response to a pressure; a first check valve configured to transmit wellbore fluid from the wellbore into a second chamber defined by the ratcheting setting tool; and a second check valve configured to transmit wellbore fluid from the second chamber into an expandable seal in response to the piston moving from the first position to the second position.

Example 16 is the ratcheting setting tool of example(s) 15, further comprising: an extension piece extending from the piston into the second chamber; a first seal coupleable to the piston in the first chamber; and a second seal coupleable to the extension piece in the second chamber.

Example 17 is the ratcheting setting tool of any of example(s) 15-16, further comprising: a first rupture disk positionable on a first port in the first chamber.

Example 18 is the ratcheting setting tool of any of example(s) 15-17, further comprising: a second rupture disk positionable on a second port of the second chamber.

Example 19 is the ratcheting setting tool of any of example(s) 15-18, wherein the expandable seal is a first expandable seal on a tubing string deployable downhole in the wellbore, and wherein the ratcheting setting tool is coupleable to a control line configurable to transmit wellbore fluid from a third port of the second chamber and into a second inflatable packer via an inlet port.

Example 20 is the ratcheting setting tool of any of example(s) 15-19, further comprising: a first port in the first chamber configured to receive the pressure; an annulus port in the second chamber, wherein the first check valve is positioned in the annulus port; and a second port in the second chamber coupleable to the expandable seal, wherein the second check valve is positioned in the second port.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

an expandable seal positionable downhole in a wellbore; and a setting tool comprising:

a piston positionable within a first chamber defined by the setting tool, the piston movable from a first position to a second position within the first chamber in response to a pressure;

a first check valve configured to transmit wellbore fluid from the wellbore into a second chamber defined by the setting tool, wherein the first check valve is positioned within an inflow port in the second chamber; and a second check valve configured to transmit wellbore fluid from the second chamber into the expandable seal in response to the piston moving from the first position to the second position.

2. The system of claim 1, wherein the setting tool further comprises:

an extension piece extending from the piston into the second chamber;

a first seal coupleable to the piston in the first chamber; and a second seal coupleable to the extension piece in the second chamber, wherein the setting tool is a hydraulic setting tool.

3. The system of claim 1, wherein the expandable seal is positionable between an outer surface of a perforated tubing string and a hydraulic screen, and wherein the expandable seal is configurable to expand the hydraulic screen in the wellbore.

4. The system of claim 1, wherein the inflow port is an annulus port, and wherein the setting tool further comprises:

a first port in the first chamber configured to receive the pressure; and a second port in the second chamber coupleable to the expandable seal, wherein the second check valve is positioned in the second port.

5. The system of claim 4, further comprising:

a first rupture disk positionable on the first port of the setting tool.

6. The system of claim 4, wherein the annulus port is a first annulus port, and wherein the system further comprises:

a second rupture disk positionable on a second annulus port of the second chamber.

7. The system of claim 1, wherein the inflow port is positioned between the second chamber and a tubing string.

8. The system of claim 1, wherein the inflow port is positioned between the second chamber and an annulus between a tubing string and the wellbore.

9. A method comprising:

receiving, by a setting tool positioned downhole in a wellbore, a pressure;

moving a piston within a first chamber defined by the setting tool from a first position to a second position in response to receiving the pressure;

transmitting, by a first check valve in a second chamber defined by the setting tool, wellbore fluid from the wellbore into the second chamber, wherein the first check valve is positioned within an inflow port in the second chamber; and transmitting, by a second check valve in the setting tool, the wellbore fluid from the second chamber into an expandable seal in response to the piston moving from the first position to the second position.

10. The method of claim 9, wherein the setting tool is a hydraulic setting tool, wherein the pressure is a first pressure, and wherein the method further comprises:

applying, by the piston, a second pressure to the wellbore fluid in the second chamber in response to the first pressure being applied from a surface of the wellbore, wherein the second pressure is greater than the first pressure.

11. The method of claim 9, further comprising:

moving, by the piston, from the second position to the first position subsequent to the second check valve transmitting the wellbore fluid from the second chamber into the expandable seal; and transmitting, by the first check valve, additional wellbore fluid into the second chamber in response to the piston moving from the second position to the first position.

12. The method of claim 9, wherein the expandable seal is a first expandable seal on a tubing string deployed downhole in the wellbore, and wherein the method further comprises:

transmitting, by a control line, the wellbore fluid from the second chamber of the setting tool and into a second expandable seal.

13. The method of claim 9, further comprising:

expanding the expandable seal in response to transmitting the wellbore fluid from the second chamber into the expandable seal; and expanding a hydraulic screen surrounding the expandable seal against the wellbore in response to expanding the expandable seal.

14. The method of claim 9, further comprising:

rupturing a first rupture disk positioned on a first port in the first chamber in response to a downhole pressure of the wellbore exceeding a rupture threshold.

15. The method of claim 9, further comprising:

rupturing a second rupture disk on a second port in the second chamber in response to a downhole pressure of the wellbore exceeding a rupture threshold.

16. A setting tool comprising:

a piston positionable within a first chamber defined by the setting tool that is positionable downhole in a wellbore, the piston movable from a first position to a second position within the first chamber in response to a pressure;

a first check valve configured to transmit wellbore fluid from the wellbore into a second chamber defined by the setting tool, wherein the first check valve is positioned within an inflow port in the second chamber; and a second check valve configured to transmit wellbore fluid from the second chamber into an expandable seal in response to the piston moving from the first position to the second position.

17. The setting tool of claim 16, further comprising:

an extension piece extending from the piston into the second chamber;

a first seal coupleable to the piston in the first chamber; and a second seal coupleable to the extension piece in the second chamber.

18. The setting tool of claim 16, further comprising:

a first rupture disk positionable on a first port in the first chamber.

19. The setting tool of claim 16, further comprising:

a second rupture disk positionable on a second port of the second chamber.

20. The setting tool of claim 16, wherein the inflow port is an annulus port, and wherein the setting tool further comprises:

a first port in the first chamber configured to receive the pressure; and a second port in the second chamber coupleable to the expandable seal, wherein the second check valve is positioned in the second port.

* * * * *